United States Patent [19]

Uriu

[11] 3,935,992

[45] Feb. 3, 1976

[54] BOX THAT FUNCTIONS BOTH AS ENCLOSED CONTAINER AND OPEN RECEPTACLE

[76] Inventor: Kohei Uriu, No. 107, Minamiushiroya, Yashiomachi, Minami Saitama, Saitama, Japan

[22] Filed: Nov. 27, 1974

[21] Appl. No.: 527,892

[30] Foreign Application Priority Data

Feb. 26, 1974 Japan ..... 49-22238[U]

[52] U.S. Cl. ..... 229/38; 229/39 R; 206/135

[51] Int. Cl.[2] ..... B65D 5/10

[58] Field of Search ..... 229/39 B, 38 R; 206/63.5, 206/130, 132, 133, 135, 136, 246

[56] References Cited

UNITED STATES PATENTS

| | | | |
|---|---|---|---|
| 2,125,313 | 8/1938 | Ringler | 229/39 B |
| 2,451,644 | 10/1948 | Wood | 229/39 R |
| 2,537,151 | 1/1951 | Mires | 229/39 B |
| 2,614,883 | 10/1952 | Anderson et al. | 229/39 R X |
| 2,794,544 | 6/1957 | Firth | 229/39 R X |
| 3,026,014 | 3/1962 | Cornell et al. | 229/38 |
| 3,361,327 | 1/1968 | Waldrop | 229/38 |

*Primary Examiner*—Davis T. Moorhead

[57] ABSTRACT

A paper box which can be repeatedly used as a waste box etc. after it has been used as an ordinary container. Four lid members which are formed integrally with four sides of the box body, respectively are adapted to be inwardly turned down and to engage with each other through some means when the box is used as a waste box etc.

5 Claims, 8 Drawing Figures

BOX THAT FUNCTIONS BOTH AS ENCLOSED CONTAINER AND OPEN RECEPTACLE

The present invention relates to a box made of ordinary thick paper and corrugated cardboard or the like, and more particularly to a paper box of a size sufficient for encasing therein bottles, cans, etc. as in ordinary use, and more definitely speaking, said paper box is of a size as large as a waste box used in a room.

Boxes of the kind have been popularly used for transporting, storing, etc. of several kinds of goods. But under the present conditions almost all of these boxes are thrown away immediately after they have been used as ordinary containers. It is wasteful to use something only once and then throw it away, and therefore it is undesirable from an economical point of view.

It is also undesirable in view of the problem of refuse disposal to throw away empty boxes.

The present invention has been made in order to get all the use out of a paper box even after it has been used for the primary purpose.

It is an object of the present invention to provide a paper box which is adapted to be used as a waste box without losing its original function as a box.

It is another object of the present invention to provide a paper box which can be promptly modified into a waste box and handy to carry.

It is a further object of the present invention to provide a paper box used as a waste box, of which trash is difficult to get out even when said box tumbles down.

It is a still further object of the present invention to provide a paper box which can be repeatedly used.

It is a still further object of the present invention to provide a paper box which may be used as an advertising means.

According to the present invention, there is provided a paper box consisting essentially of a box body with a bottom; a first lid member one end of which is formed integrally with one side of the box body; a second lid member formed integrally with another side of the box body opposite to said first lid member; and third and fourth lid members formed opposite to each other and integrally with the other two sides of the box body, said third and fourth lid members each having slanting slots at both sides thereof for receiving both corner edges of said first lid member and said second lid member, respectively.

The invention will be better understood from the following description taken in connection with the accompanying drawings in which.

Figure 1:
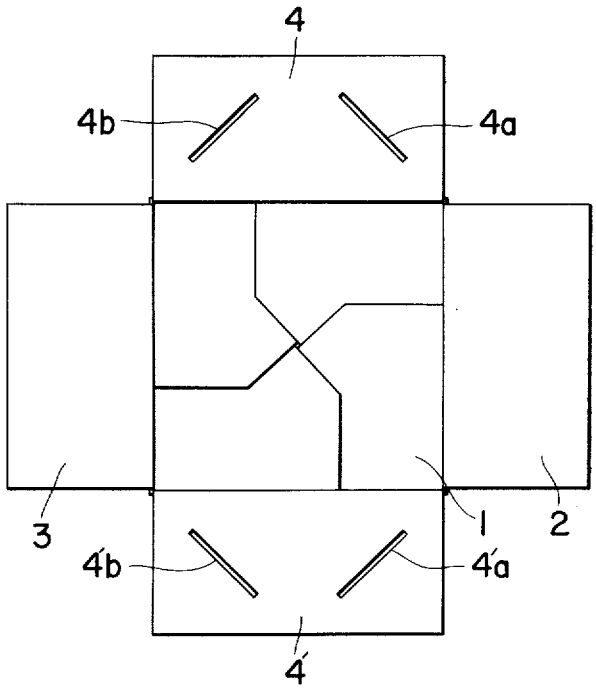
FIG. 1 is a plan view of one form of a paper box of the present invention used as an ordinary box, with a first, a second, a third and a fourth lid members being open.
Figure 3:
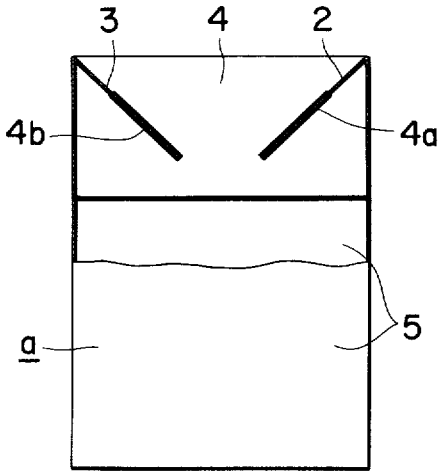
FIG. 3 is a side view of the paper box partially cut out along the line III — III of FIG. 2.
Figure 2:
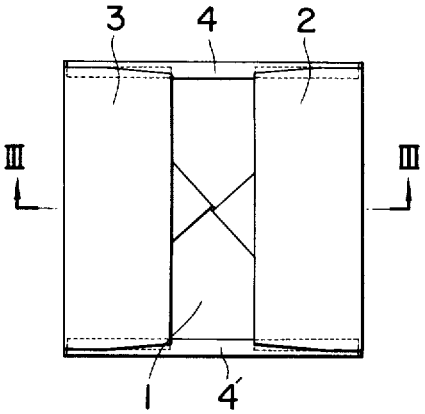
FIG. 2 is a plan view of the paper box of FIG. 1 when used as a waste box.

Referring now to FIGS. 1 to 3, there is illustrated one form of a paper box according to the present invention.

Character *a* represents a box body made of thick paper, corrugated cardboard or the like. A bottom 1 is formed in a conventional manner, for example, as shown in FIGS. 1 and 2, four sheets are formed to engage with each other. A first lid member 2 is formed integrally with one side of the box body a at its one end. Numeral 3 designates a second lid member formed integrally with another side of the box body opposite to said first lid member 2, and numerals 4 and 4′ designate a third lid member and a fourth lid member, respectively, formed opposite to each other and integrally with the other two sides of the box body. These first, second, third and fourth lid members each have a size about half as large as the mouth area of the box, and are employed as covering means when the box is used as an ordinary container, or as means for preventing trash getting out of the box when used as a waste box. Slanting slots 4*a* and 4*b* are formed at both sides of said third lid member 4, and slanting slots 4′*a* and 4′*b* are formed at both sides of said fourth lid member 4′.

With such construction as defined above, in case where the box is used as a container the third lid member 4 and the fourth lid member 4′ are horizontally folded inwards and then the first and the second lid members are laid upon said third and fourth lid members.

The above box is re-formed to a waste box in such a manner as explained hereinbelow.

The third lid member 4 and the fourth lid member 4′ are further folded down from the former position to the extent that said lid members may touch the sides 5 of the box body, respectively. Then, the first and the second lid members are also folded down. Both corner edges of the first lid member 2 are inserted into the slanting slots 4*a* and 4′*a*, respectively, and both corner edges of the second lid member 3 are inserted into the slanting slots, 4*b* and 4′*b*, respectively.

When the lid members 2 and 3 are pulled up with a finger, the engagement is released and the box is used again as a container.

Referring to FIGS. 4 to 8, there is illustrated another form of a paper box according to the present invention.

Figure 4:
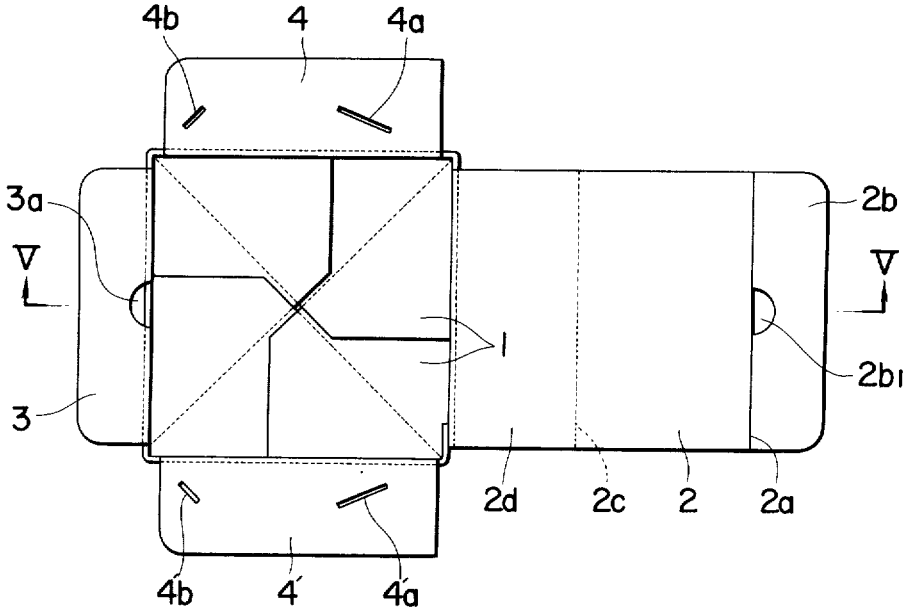
FIG. 4 is a plan view of another form of a paper box of the present invention used as an ordinary box, with a first, a second, a third and a fourth lid members being open.

In this embodiment a first lid member 2 is made as large as the mouth area of the box, and has an extension 2*b* through a crease 2*a*. Perforation 2*c* is perforated in said first lid member 2 at a portion between the end connected with the box body and the crease 2*a*, traversing said first lid member and substantially parallel with a forward end line of said extension 2*b*. A hole $2b_1$ is made in the extension 2*b* as shown in FIG. 4.

Figure 5:
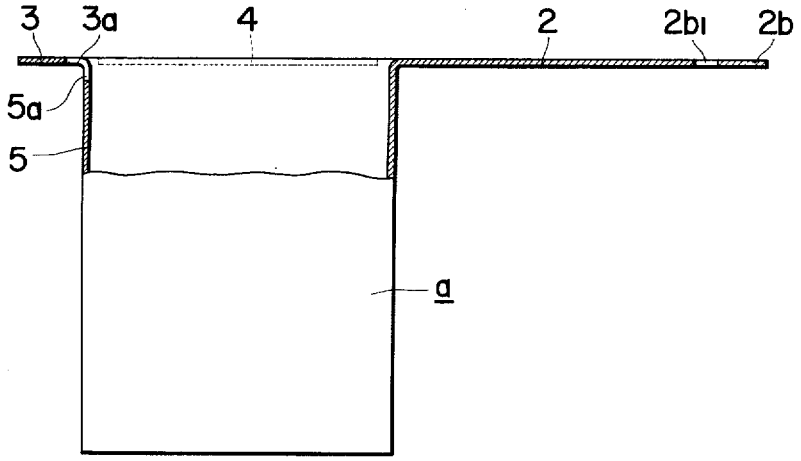
FIG. 5 is a side view partially cut out along the line V —V of FIG. 4.
Figure 6:
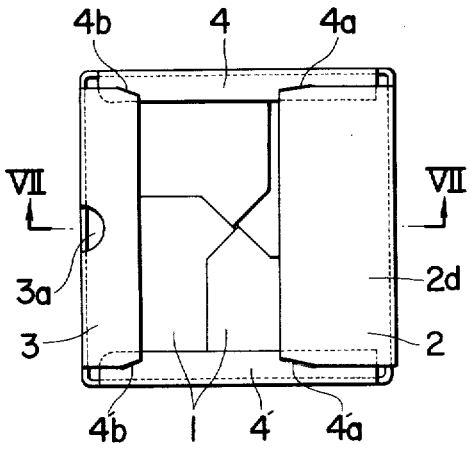
FIG. 6 is a plan view of the box of FIG. 4 when used as a waste box.
Figure 7:
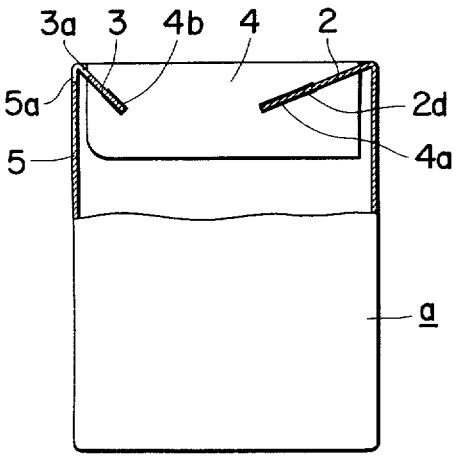
FIG. 7 is a side view partially cut out along the line VII — VII of FIG. 6.
Figure 8:
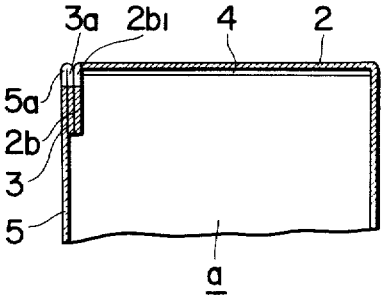
FIG. 8 is a fragmentary sectional view of the paper box of FIG. 4 with lid members being folded.

A second lid member 3, a third lid member 4 and a fourth lid member 4′ may have width narrower than those of FIG. 1 so far as they act as reinforcing means when the box is used as an ordinary container, or as means for preventing trash getting out of the box when used as a waste box. A hole 3*a* is made in said second lid member 3 and a hole 5*a* is made in the side 5 of the box body with which said second lid member is connected, said holes 3*a* and 5*a* being made to communicate as depicted in FIGS. 5, 7 and 8. Like the former embodiment, slanting slots 4*a* and 4*b* are formed at both sides of said third lid member 4, respectively, and slanting slots 4′*a* and 4′*b* are formed at both sides of said fourth lid member 4′, respectively.

When the box is to be used as a container, as shown in FIG. 8, the second lid member 3 is inwardly turned down to the extent that said lid member 3 may touch the side 5 of the box body, the third lid member 4 and the fourth lid member 4' are horizontally folded inwards, and then the first lid member 2 is laid upon said third and fourth lid members. In this instance the extension 2*b* is inserted into the box body. The hole $2b_1$ exactly meets with said holes 3*a* and 5*a* so that the first lid member 2 can be easily opened by a finger.

Now, there will be explained hereinunder how to re-form a waste box from the above box.

A part of the first lid member 2 together with the extension 2*b* is cut off along the line made by the perforation 2*c* which traverses the first lid member and is substantially parallel with a forward end line of said extension 2*b*. A remaining portion 2*d* is still connected to the box body. The third lid member 4 and the fourth lid member 4' are further folded down from the position shown in FIG. 8 to the position shown in FIGS. 6 and 7. Into the slanting slots 4*a* and 4'*a* are inserted both corner edges of the remaining portion 2*d* of the first lid member 2, respectively, and into the slanting slots 4*b* and 4'*b* are inserted both corner edges of the second lid members 3, respectively. Owing to these four inwardly inclined members 2, 3, 4 and 4' which engage with each other, the box is handy to carry and trash in said waste box is difficult to get out therefrom even when the box tumbles down. As said third lid member 4 and the fourth lid member 4' are always inclined to be restored to the original state, a proper form of the box as a waste box is always maintained.

If outer surface of the box body is printed with some propaganda phrases or pictures, said box is also useful as an advertising means.

As mentioned above, accordingly to the present invention, there is provided a paper box which can be repeatedly used as a waste box etc. and which is very useful in view of various aspects.

It should be noted that the box thus modified can be used not only as a waste box but also for various purposes.

While I have shown and described certain preferred embodiments of the invention, it is to be understood that the invention is not limited thereto but may be otherwise variously embodied within the scope of the following claims.

What is claimed is:

1. A box that functions both as an enclosed container and an open receptacle, comprising a bottom member, side wall members extending upwardly from said bottom member, lid members extending from said side wall members and being of the same uniform width as said side wall members from which they extend and being of sufficient length such that when all of said lid members are folded at the junctures of said lid members and said side wall members there is formed to top that effectively covers the box permitting same to function as an enclosed container, at least two of said lid members each being provided with two slotted openings spaced inwardly from the free edges thereof such that as said at least two of said lid members are folded inwardly and downwardly along their corresponding side wall members said slotted openings are thereby positioned to slope downwardly and inwardly from positions near the corners of the tops of their corresponding side wall members such that as at least two of the remaining of said lid members are folded inwardly and downwardly the edges thereof are positioned within said slotted openings to thus form an open receptacle.

2. A box as in claim 1, wherein said bottom member, side wall members and lid members are paper.

3. A box as in claim 2, wherein the free ends of said lid members that are located opposite the juncture of said lid members and their corresponding side wall members are parallel to the juncture of said lid members and their corresponding side wall members about which said lid members are folded such that the edges of said lid members form right angles, and wherein said slotted openings slope downwardly at 45° angles with respect to the side wall members corresponding to said at least two of the remainder of said lid members.

4. A box as in claim 3, wherein the width of each of said lid members is the same extending and approximately one-half of the width of the side walls.

5. A box as in claim 1, wherein said at least two of the remainder of said lid members comprise a first member extending from its corresponding side wall member, a second member extending from the opposite side wall member, a third member extending from said second member and a fourth member extending from said third member and being of substantially the same shape and configuration as said first member, said second and third members being joined along a perforated line, such that said second and third members extend across the entire width of said box when said first and fourth members are folded inwardly within said box, while after said third and fourth members have been removed from said box by tearing along said perforation the edges of said first and second members are positioned within said slotted openings.

* * * * *